United States Patent [19]

Keinborg et al.

[11] Patent Number: 4,532,017

[45] Date of Patent: Jul. 30, 1985

[54] FLOATING CATHODE ELEMENTS BASED ON ELECTRICALLY CONDUCTIVE REFRACTORY MATERIAL, FOR THE PRODUCTION OF ALUMINUM BY ELECTROLYSIS

[75] Inventors: Maurice Keinborg, St Jean de Maurienne; Philippe Varin, Paris; Yves Bertaud; Michel Leroy, both of St Jean de Maurienne, all of France

[73] Assignee: Aluminium Pechiney, Lyons, France

[21] Appl. No.: 446,626

[22] Filed: Dec. 3, 1982

[30] Foreign Application Priority Data

Dec. 11, 1981 [FR] France ..... 81 23780

[51] Int. Cl.[3] ..... C25C 3/06; C25C 3/08; C25B 11/12

[52] U.S. Cl. ..... 204/67; 204/243 R; 204/286; 204/291; 204/293; 204/294; 204/297 R; 204/288; 204/289

[58] Field of Search ..... 204/67, 291, 243–247, 204/280, 286, 297 R, 288, 289, 294, 291

[56] References Cited

U.S. PATENT DOCUMENTS

| | | | |
|---|---|---|---|
| 3,407,132 | 10/1968 | Meyer | 204/286 |
| 3,554,893 | 1/1971 | De Varda | 204/244 |
| 4,177,128 | 12/1979 | Rahn | 204/243 R |
| 4,243,502 | 1/1981 | Kugler | 204/243 R |
| 4,338,177 | 7/1982 | Withers et al. | 204/243 R |
| 4,349,427 | 9/1982 | Goodnow et al. | 204/243 R |
| 4,462,886 | 7/1984 | Kugler | 204/286 X |

*Primary Examiner*—Donald R. Valentine

*Attorney, Agent, or Firm*—Oblon, Fisher Spivak, McClelland & Maier

[57] ABSTRACT

The invention concerns floating cathode elements which are intended for the electrolytic production of aluminum using the Hall-Heroult process in an electrolysis tank comprising a molten cryolite-base bath, between a carbon anode, and a cathodic layer of molten aluminum, said elements comprising at least one active cathode element (30) formed of electrically conductive refractory material such as titanium diboride and supported by an intermediate support (31) which is inert with respect to the liquid aluminum and the electrolyte, the mean relative density of the assembly of the acitve cathode element and the inert intermediate support being lower than the relative density of the liquid aluminum under the normal conditions of operation of the electrolysis tank. They may also and preferably be provided with anchoring and abutment means (32) for limiting the amplitude of movements thereof in a vertical direction, and guide means for limiting the amplitude of movements thereof in directions other than a vertical direction.

20 Claims, 15 Drawing Figures

FLOATING CATHODE ELEMENTS BASED ON ELECTRICALLY CONDUCTIVE REFRACTORY MATERIAL, FOR THE PRODUCTION OF ALUMINUM BY ELECTROLYSIS

The present invention concerns floating cathode elements, of electrically conductive refractory material, such as titanium diboride, which are intended for the production of aluminium by electrolysis, using the Hall-Heroult process.

In Hall-Heroult cells, the cathode is invariably formed by juxtaposed blocks of carbon, in which metal bars are sealed, the metal bars themselves being connected to conductors for forming the electrical connection to the following tank in the series. In operation, the cathode is permanently covered by a layer of liquid aluminium, which is about twenty centimeters in thickness.

In modern tanks, which operate at current strengths which are up to or exceed 200,000 amperes, an interpolar distance of at least 40 millimeters must be maintained between the anodes and the surface of the layer of liquid aluminium, in order to ensure that waves which occur at the interface between the metal produced and the electrolysis bath do not entrain aluminium or sodium in metal form or in partially reduced form, back towards the anode where they would suffer from re-oxidation. That causes a substantial additional voltage drop, which exceeds 1.5 volts, that is to say, more than a third of the total voltage drop at the terminals of a tank.

Among the various processes which have been envisaged for the purpose of increasing the wettability of the cathode with liquid aliuminium and reducing entrainment of the liquid aluminium back towards the anode by the combined movements of the metal and the electrolysis bath, the use of electrically conductive refractory compounds, in particular titanium and zirconium borides, is widely employed.

Generally, electrically conductive refractory materials fall into the class formed by borides, carbides and nitrides of the metals of Groups 4A, 5A and 6A, but, hitherto, research has been essentially directed to titanium and zirconium diborides $TiB_2$ and $ZrB_2$.

Those electrically conducting refractory materials, taken separately or in combination, may be employed in electrolysis tank of the Hall-Heroult type, insofar as they simultaneously have the following three properties:

Electrical resistivity of less than 1000 $\mu\Omega$cm and preferably 100 $\mu\Omega$cm at a temperature of from 950° to 970° C., Good wettability by liquid aluminium, and Chemical and physical inertness with respect to the liquid aluminium and the electrolysis bath.

At a temperature of 1000° C., titanium boride has a resistivity of 60 $\mu\Omega$cm and zirconium boride has a resistivity of 74 $\mu\Omega$cm, that is to say 2 and 2.5 times that of liquid aluminium respectively, but more than 5000 times less than that of the electrolysis bath, which is of the order of 450,000 $\mu\Omega$cm. They are perfectly well wetted by liquid aluminium and are sufficiently inert with respect to the molten cryolite.

However, the very high cost of titanium and zirconium borides and the sensitivity of such substances, in the solid state, to thermal shocks, have hitherto tended to prevent those two materials from being used to produce solid cathode blocks under practical industrial conditions, the tendency is to use either reduced-thickness coatings which are produced by various processes, such as vapour phase deposit or solid-state diffusion, or solid elements which are sealed in the carbon cathode, projecting from the layer of liquid aluminium produced. A complete description thereof is found in two articles in the German journal "Aluminium" on pages 642–648 (October 1980) and pages 713–718 (November 1980) by K. BILLEHAUG and H. A. OYE, under the title "Inert cathodes for aluminium electrolysis in Hall-Heroult cells".

The above-mentioned coatings of small thickness or small dimensions, of titanium or zirconium boride, provide a relatively satisfactory solution to the problem of the electrical conductivity of the cathode blocks and their ability to be wetted by liquid aluminium, but unfortunately they suffer from a relatively high rate of wear due to progressive dissolution thereof in the liquid aluminium with which they are in contact. It is estimated that the consumption of $TiB_2$ may be up to 200 grams per tonne of aluminium produced, and $TiB_2$ costs several hundreds of francs per kilo at the present time. In addition, replacing the worn-out cathode elements involves totally stopping and partially dismantling the electrolysis tank, and that is unacceptable under practical industrial conditions.

Cathode elements of titanium boride for the production of aluminium using the Hall-Heroult process were initially described in the following French patents:

French Nos. 1 195 505-1 203 015-1 205 857-1227 951-1 229 537-1 148 068-1 149 468 to BRITISH ALUMINIUM COMPANY Ltd., and No. 1 165 136 to KAISER ALUMINIUM and, more recently, in French Pat. Nos. 2 337 210 to ALCOA-2 430 464 to ALUSUISSE, U.S. Pat. No. 4,177,128 to PPG INDUSTRIES-U.S. Pat. No. 4,093,524 to KAISER ALUMINIUM, but it does not appear that they have given rise to exploitation thereof on an industrial scale.

Likewise, French Pat. No. 2 471 425 (ALUSUISSE) describes cathode elements of titanium diboride in the form of granular material or in the form of pieces, which is poured loosely onto the bottom of the tank and covered by a thickness of liquid aluminium which is at least 2 mm.

In our French Pat. No. 2.500.488. (ALUMINIUM PECHINEY), we described and claimed in particular a process for the production of aluminium using the Hall-Heroult method, comprising electrolysis of dissolved alumina in a bath based on molten cryolite, at a temperature of the order of from 930° to 960° C., between a cathode system comprising a carbon substrate permanently covered by a layer of liquid aluminium and an anode system comprising at least one carbon anode. The system is characterised in that a plurality of titanium diboride elements are disposed on the carbon cathode substrate, said elements not being connected to said substrate and not being connected to each other and forming a bed of regular thickness on said substrate. The thickness of the layer of liquid aluminium is adjusted to a value which is at most equal to the thickness of the bed of titanium diboride elements, and the distance between the plane of the anode system and the upper plane of the bed of titanium boride elements is fixed at a value of from 30 to 10 millimeters. Also disclosed therein is a cathode for carrying the process into effect, characterised in that it comprises a carbon substrate covered by a plurality of titanium diboride elements which are not connected to the substrate and which are not connected to each other, forming a bed of regular thickness on said substrate.

In accordance with the main patent, the cathode may comprise an intermediate carbon support which is placed on the base carbon substrate and which supports the bed of titanium diboride particles.

Finally, the certificate of addition to the same patent (No. 81 12909) which is also in the name of ALUMINIUM PECHINEY describes and claims removable cathode elements comprising an inert intermediate support and active elements of electrically conductive refractory material such as $TiB_2$, which are firmly connected or integral but separable from said support, the assembly formed by the inert intermediate support and the active elements being of a relative density which is higher than the relative density of the liquid aluminium at the temperature of the electrolysis operation.

However, using the cathode elements of electrically conductive refractory material, which can be wetted with liquid aluminium, being the subject of patent No. 2.500.488 and application No. 81 12909 for a certificate of addition may suffer under certain circumstances from a number of disadvantages:

- the thickness of the layer of liquid metal in which the bed of wettable elements is immersed is small and may locally become the location of intense horizontal electric currents. These give rise to the danger of inducing electromagnetic forces which tend to produce movement of the metal and to entrain the wettable conducting elements, thereby altering the uniformity of the bed formed by the conducting elements;
- In the case of an anode effect, it is impossible for the anode to be brought into contact with the layer of liquid aluminium, by moving the anode downwardly, thereby to depolarise the anodic level;
- In order periodically to be able to take off the volume of metal produced, it is necessary for the cathode to be provided therein with a well or channel forming a reservoir which drains off the material flowing from the cathodic bed. The magnitude of the volume of the reservoir and various problems in regard to electrical insulation can complicate the design of the bottom of the tank and increase the cost thereof;
- In the case of the bottom of the tank becoming sludged up with undissolved electrolyte and alumina sludges, the bed, being small in thickness, will be rapidly masked by the sludges, disturbing operation of the cell, and
- There is the danger of damage to or even destruction of the elements of the inert intermediate support and the $TiB_2$ elements in the event of an anode dropping down or moving downwardly in an uncontrolled manner.

The aim of the present invention is to overcome the above-mentioned disadvantages. It is based on elements of electrically conductive refractory materials, which are wettable by means of liquid aluminium and in particular based on titanium diboride, which are not directly connected to the cathode substrate, which are guided and which have a limited degree of freedom, in the vertical direction, and which are maintained in a floating condition at the interface between the electrolysis bath and the aluminium produced, irrespective of the fluctuations in that interface during the electrolysis operation, by having them supported by an inert intermediate support which is of lower relative density than the liquid aluminium.

In addition, the above-mentioned elements are removable so that they can be set in position and replaced without interrupting the electrolysis operation, with optional intermediate passage through a controlled preheating or cooling chamber, with or without a controlled atmosphere.

The following definitions of terminology will be used throughout the specification hereinafter:

- Floating cathode element: the assembly formed by an inert intermediate support and at least one removable active cathode element, characterised in that the mean relative density thereof is less than the relative density of the liquid aluminium under normal conditions of operation of Hall-Heroult tanks;
- Anchoring means: a structure which is of higher relative density than liquid aluminium under the normal conditions of operation of Hall-Heroult tanks, made either of a refractory or ceramic material, or of metal covered with a protective layer, and characterised in that it comprises at least one abutment or device for limiting in an upward direction the vertical movement of one or more floating cathode elements;
- Guide means: a mechanical system, the purpose of which is to limit lateral motion of one or more floating cathode elements, while leaving it or them freedom to move in the vertical direction, such freedom possibly being limited by the anchoring means. The guide means and the anchoring means may be partially or totally combined together; and
- Interface: the interface between the layer of liquid aluminium produced by electrolysis, and the electrolyte (molten cryolite).

As titanium diboride is of a relative density which is very much higher than that of liquid aluminium at the temperature (about 960° C.) of the electrolysis operation (about 4.5 as compared to 2.3 to 2.1–2.2 in regard to the electrolyte), it may be used to form floating cathode elements in accordance with one of the following three alternative ways:

1. The elements are disposed on an inert substrate of substantially lower relative density than the liquid aluminium, and the ratio of the mass of the inert substrate to the mass of $TiB_2$ is so adjusted that the relative density of the assembly is less than that of liquid aluminium (2.3) and higher than that of the electrolyte (the expression inert substrate means that the main function of the substrate is not to serve, in itself, as a cathode for the electrochemical deposition of metal aluminium).
2. The procedure is as in the case of the first alternative method referred to above, but in addition, the elements are retained at the interface by anchoring to the cathodic substrate, which leaves them a degree of freedom in the vertical direction.
3. A graphite float (relative density of 1.6 to 2 at a temperature of 960° C.) is added to the $TiB_2$ elements so that the assembly of element + float is of a lower relative density than the electrolyte (between 2.1 and 2.2 in the temperature range of from 930° to 960° C.). The assemblies float above the bath-metal interface. Electrical conduction towards the cathode is then effected by conducting tails which are immersed in the layer of metal.

FIG. 1 shows a floating cathode element provided with a plurality of removal active $TiB_2$ elements.

FIGS. 2 and 3 show two possible forms of active $TiB_2$ elements.

FIGS. 4 and 5 show two floating cathode elements provided with active $TiB_2$ elements of slotted tubular shape, and means for anchoring to the substrate.

FIG. 6 shows a floating cathode element anchored in a block of dense refractory concrete.

FIG. 7 shows a means for laterally guiding a floating cathode element.

FIG. 8 shows another type of floating cathode element with top and bottom abutments which are integrated into the refractory support.

FIG. 9 shows a detail view of such abutments.

FIGS. 10 to 13 show various alternative embodiments of individual floating cathode elements, each active $TiB_2$ element being provided with its own float, and FIGS. 14 and 15 show an application of the floating cathode elements to electrolysis tanks with cathodic output at the top, in which the current is collected in the layer of aluminium.

Figure 1:
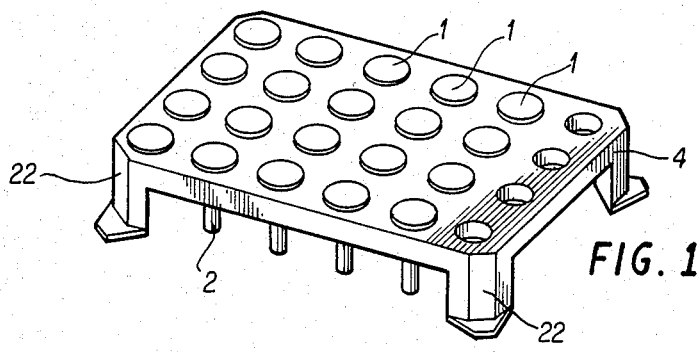
FIGS. 1 to 15 illustrate the various ways of carrying the invention into effect.

Referring to FIG. 1, the active cathode element 1 comprising $TiB_2$ is formed by a flat or slightly curved head portion and a tail or shank portion 2 which is positioned in the apertures 3 in an inert intermediate support 4 comprising graphite. The mean relative density of the cathodic assembly which is formed in the above-indicated manner is less than that of liquid aluminium. The head portions of the stud elements 1 are in normal operation disposed in the vicinity of the interface between the electrolyte and the layer of aluminium.

Figure 2:
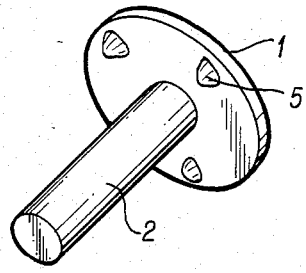
Figure 3:
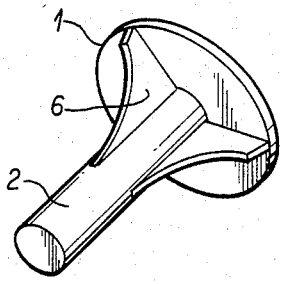

The cathode element 1 may rest directly on the aperture 3 or may be provided with bosses 5 or vanes 6 which define a gap to promote the flow of liquid aluminium as it is produced (see FIGS. 2 and 3).

Figure 4:
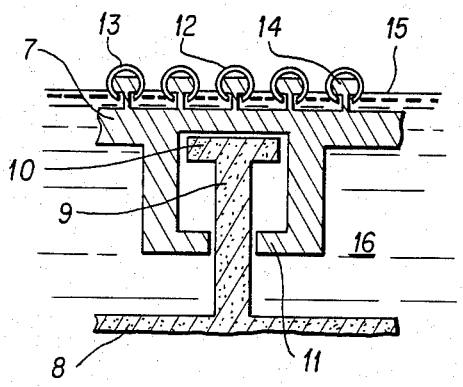
Figure 5:
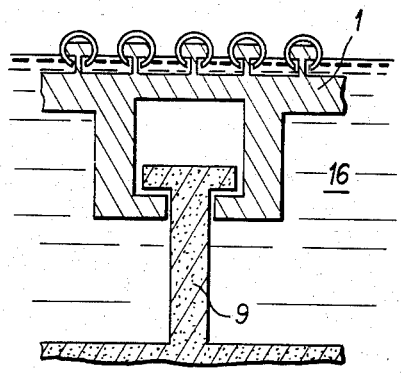

FIGS. 4 and 5 show another embodiment in which the floating element 7 is anchored to the cathodic substrate 8 by stud members 9. The head portion 10 of the anchoring stud member 9 co-operates with a step configuration illustrated at 11 on the intermediate support 7 to define an abutment means for limiting the movement thereof in an upward direction. The active cathode elements 12 are formed by slotted tube portions 13 which are threaded onto a rail 14, leaving between them a sufficient free space for the flow of aluminium produced. The tubes 13 may be of circular, square or other section.

In the construction shown in FIG. 5, the ratio between the mass of graphite and the mass of $TiB_2$ is such that the mean relative density of the assembly is lower than the relative density of the electrolyte, so that the floating cathode element is normally in an upwardly abutting condition.

In both cases, the movement of the floating element which is defined by the position of the abutment member and the height of the anchoring stud member 9 must be at least equal to the variations in the height of the surface of the layer of liquid aluminium in the course of the metal being produced by electrolysis and drawn off.

Generally, the active $TiB_2$ elements 12 must project beyond the interface 15 by at least 10 millimeters.

In addition, care is taken to ensure that there is a conductor plate 7 which is sufficiently thick as always to be assured that the base thereof is immersed in the metal, irrespective of the variations in the height of the surface of the metal. It is in fact the plate 7 and not the anchoring members 9 which will transmit the current to the carbon cathode substrate 8 by way of the layer 16 of metal produced. It should be emphasised that, in all situations, it is the $TiB_2$ elements which act as the cathode, and it is on those elements that the aluminium produced by the electrolysis action is deposited.

Figure 6:
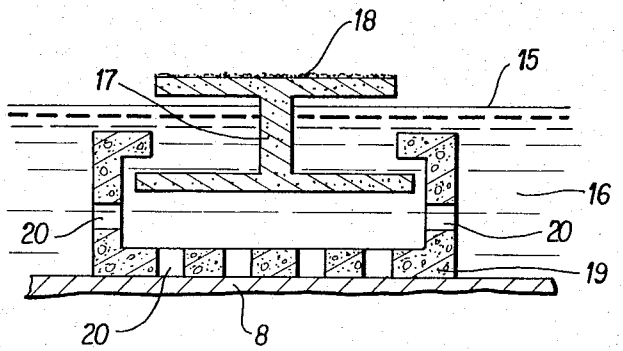

FIG. 6 shows another alternative embodiment in which the floating cathode element is formed by a plate 17 of graphite covered with a thin layer of titanium diboride 18 which is produced by chemical vapour phase deposit or by plasma torch deposition. The floating plate is anchored to the bottom by a dense block 19 of refractory concrete, which is resistant to the action of the liquid aluminium 16 and which rests on the cathodic substrate 8. Preferably, the dense block 19 is provided with passages 20 for the aluminium to circulate and for the current to flow therethrough.

Figure 8:
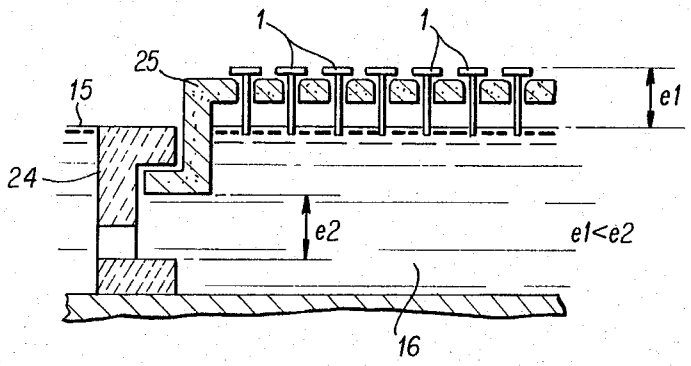
Figure 10:
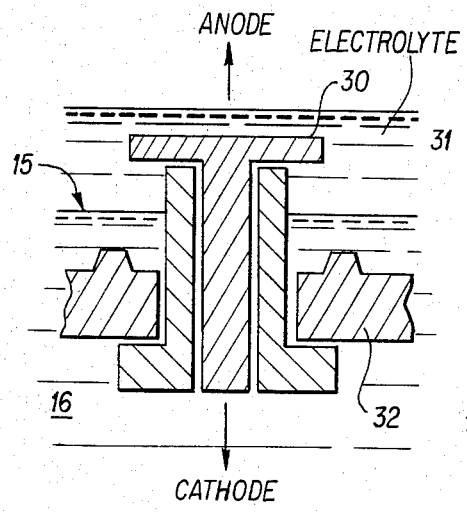

In the embodiment shown in FIG. 1, or in the case of structures similar to that shown in FIGS. 6 and 8, the floating structure may comprise guide means such as rollers 21 which co-operate for example with the support legs 22. The rollers may be formed for example of $TiB_2$ or silicon nitride or silicon and aluminium oxynitride (Sialon). In the construction shown in FIG. 8, the refractory support 24 is entirely immersed in the metal. The perforated support 25 which holds the $TiB_2$ stud members 1 is of a lower relative density than the electrolysis bath; it is for example of graphite, possibly protected by a thin coating of a refractory material such as titanium diboride or Sialon.

The advantage of this arrangement is that the whole of the perforated support+$TiB_2$ members 1 may be moved entirely into the dense refractory support when subjected to a downward thrust force (this being the situation with regard to an anode which would be lowered to an excessive degree). Therefore, the dimensions must be such that $e_1 \leqq e_2$ ($e_1$ being the height of the cathodic elements 1 above the layer of liquid aluminum, $e_2$ being the maximum travel of the floating element 25).

If the mean relative density of the assembly formed by the perforated support+$TiB_2$ stud members 1 is less than that of the bath, the perforated support permanently remains in an upwardly abutting condition. If the mean relative density of the assembly is between that of the bath and that of the metal, the perforated support follows the variations in the level of metal in the course of the electrolysis operation.

Figure 9:
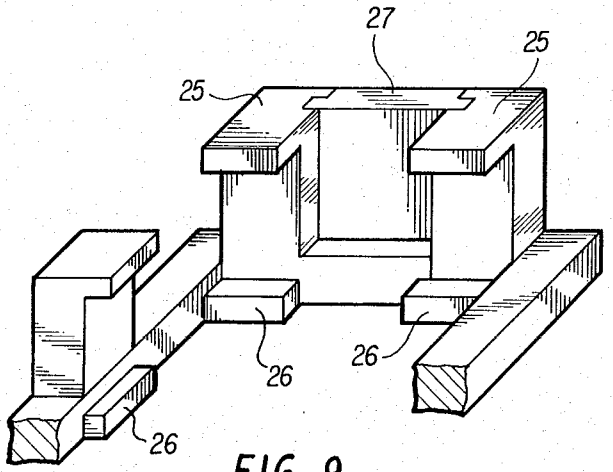

FIG. 9 shows a view of a structural detail of the dense refractory support 24 shown in FIG. 8 with the upper and lower abutment means 25 and 26 respectively. One of the faces thereof may comprise a removable wall portion 27. Fitting or removing such wall portions permits the circulation of the metal and the bath under the effect of electromagnetic forces to be directed and controlled.

FIGS. 10 to 13 show the third alternative embodiment wherein each $TiB_2$ element is associated with a graphite float. The active cathode $TiB_2$ element 30 is fitted into a graphite ring 31. An intermediate support 32 of inert material serves as an abutment in an upward direction for the graphite ring 31. The intermediate support 32 bears against the cathodic substrate by means of support or foot portions (not shown) which do not call for any particular comment.

Figure 11:
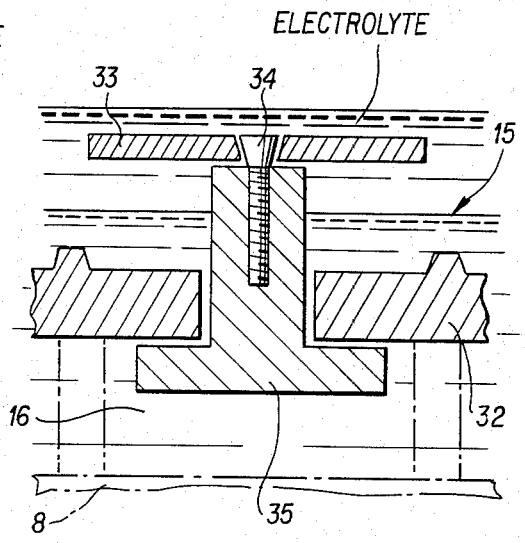

In FIG. 11, the $TiB_2$ element 33 is a plate which is secured to the graphite float 35 by means of a screw 34. The fixing may be effected by any other equivalent means.

Figure 12:
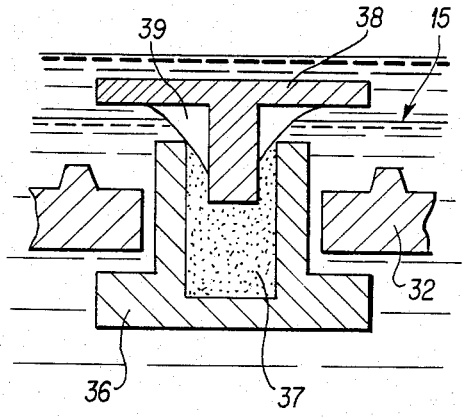
Figure 13:
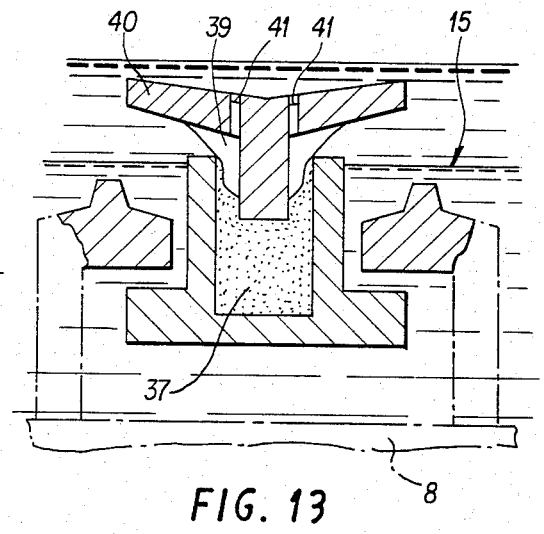

In FIGS. 12 and 13, the graphite float 36 comprises a well or shaft 37 which is closed in the lower part thereof and which is filled with liquid aluminium. The $TiB_2$ elements 38 rest on the graphite float by means of ribs or vanes 39. The "dish" shape of the element 40 as shown in FIG. 13 causes the liquid aluminium produced to come together and flow away through passages 41.

It will be appreciated that, in all the above-described embodiments, the ratio between the mass of the $TiB_2$ element and the mass of the graphite element must be so determined, taking into account the relative density of the two elements, as to give a resulting mean relative density which is either between 2.3 and 2.2 or less than 2.2 and preferably less than 2.1, in the usual temperature range of from 930° to 960° C. The above-indicated relative density values should be adapted if use is made of an electrolyte which has a relative density that is somewhat different, as a result of being of a modified composition.

Moreover, in order not to clutter the drawings, the anodic system is not illustrated, but it will be apparent that it faces the upper part of the active $TiB_2$ elements, and that it is in accordance with the present state of the art.

ADVANTAGES ACHIEVED BY THE INVENTION

Besides the well-known advantages which are achieved by using the $TiB_2$ cathode elements, which are very good electrical conductors and which can be wetted by the liquid aluminium, the present invention affords many advantages which permit a procedure which hitherto had remained experimental to be carried into effect on an industrial scale.

The $TiB_2$ stud elements individually and in particular when grouped together to form assemblies can be easily replaced, and the floating nature thereof makes them less vulnerable to mechanical shocks in operation of the arrangement: in the construction shown in FIG. 8 for example, in the event of a shock or impact when fitting or removing an anode, the floating elements 25 can retract into the dense concrete block 24 which forms the anchoring means. The height of the subjacent metal may be maintained at a sufficient value to reduce the horizontal currents and the corresponding electromagnetic interference phenomena to an acceptable value, and the operation of periodically drawing off the metal can be carried out as in a conventional electrolysis cell.

The alumina sludges which are in danger of being formed settle to the bottom of the hearth, under the metal, thus sparing the surface of the elements floating on the metal. That arrangement permits the conventional tanks to be easily converted into tanks with $TiB_2$ elements.

In addition however, the invention makes it possible to envisage a fresh conception in regard to electrolysis tanks, in which the whole of the tank lining, including the bottom, is made of non-conducting refractory material and the cathode current is collected in the layer of liquid aluminium by means of a conductor disposed in the upper part of the electrolysis tank.

Figure 7:
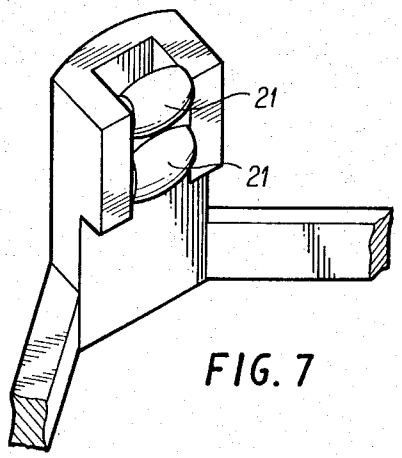
Figure 14:
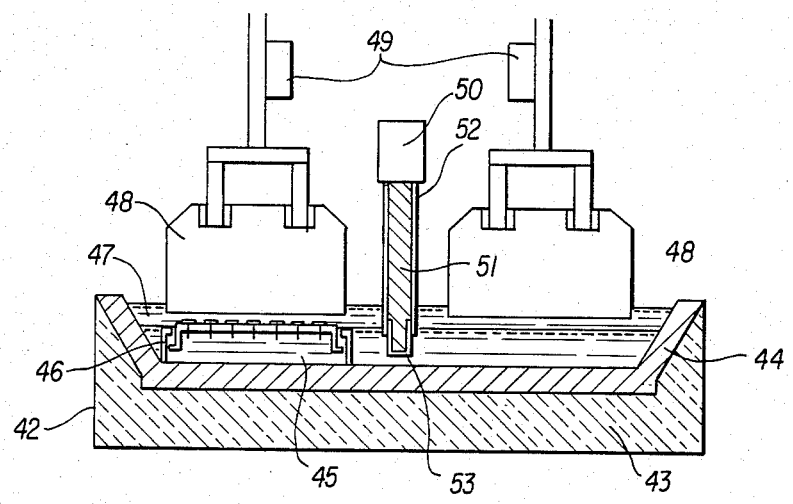
Figure 15:
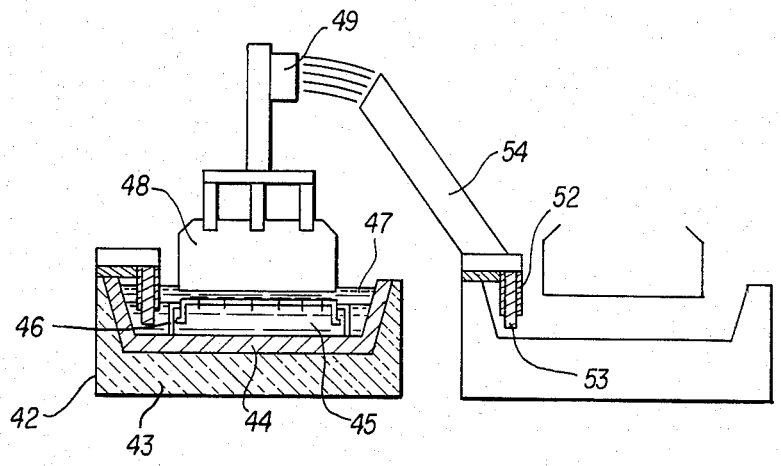

FIGS. 14 and 15 show a diagrammatic view of such a tank, with the external metal casing 42, the heat-insulating lining 43, the refractory and electrically insulating lining 44 and the layer of liquid aluminium 45; the cathode element 46 in accordance with the invention is of the type described with reference to FIG. 7; the electrolyte 47, the anodes 48 and the anodic current inputs 49 (spider arrangement).

The cathode current is connected by an element 50 comprising a vertical collector 51 which is a good electrical conductor and which is possibly protected from corrosion by an insulating sheath 52, the end thereof being capped by a cap 53 of $TiB_2$.

It might be feared that, with that arrangement, the horizontal current flowing through the layer of metal might induce unacceptable movements of the metal. In fact however, such movements are greatly attenuated by the wall portions of the means for anchoring and guiding the cathode elements. In addition, it is found that the floating cathode elements act like a real diaphragm between the layer of liquid aluminium and the anodes, so that such movements of the metal do not have any harmful influence on the faradic output, by opposing any movement towards the anode, due to convection, of metal or partially reduced species, in particular aluminium and sodium.

Thus, with an arrangement as shown in FIG. 15, it is possible to gain a large part of the voltage drop in the conventional cathode blocks (about 400 millivolts), and a part of the voltage drop (about 100 mV) in the conductors 54 which form the connections from one tank to another and which are substantially reduced in length, with a corresponding reduction in the level of capital investment corresponding to such conductors.

We claim:

1. An electrolytic cell for the production of aluminum by the Hall-Heroult process the improvement being at least one electrically conductive cathode element comprising an electrically conductive refractory material as the active cathodic material, said cathode element supported by an intermediate support which is inert with respect to liquid aluminum and the electrolyte, the mean relative density of the active cathode element and intermediate support assembly being less than 2.3; and further wherein said cathode element is in combination with an anchoring means for limiting the vertical travel of the cathode element wherein the relative density of said anchoring device is greater than the relative density of aluminum at 930° to 960° C.; and a mechanical guide means for limiting the lateral motion of said cathode element.

2. The electrolytic cell of claim 1 wherein the electrically conductive refractory material is $TiB_2$.

3. The electrolytic cell of claim 2 wherein the inert intermediate support is graphite.

4. The electrolytic cell of claim 3 wherein the relative density of the $TiB_2$ and graphite element is between 2.3 and 2.2.

5. The electrolytic cell of claim 3 wherein the relative density of the $TiB_2$ and graphite elements is less than 2.2.

6. The electrolytic cell of claim 1 wherein a plurality of electrically conductive cathode elements are supported by an inert intermediate support.

7. In a process of manufacturing aluminum by the Hall-Heroult process employing a molten cryolite-base bath as electrolyte, the improvement comprising a cathodic element of an electrically conductive refractory material as the active cathodic material which floats at the electrolyte-aluminum interface.

8. The process of claim 7 wherein the refractory material is $TiB_2$.

9. The process of claim 8 wherein the $TiB_2$ is supported on an inert support having a lower relative density than aluminum.

10. The process of claim 9 wherein the inert support is graphite.

11. The process of claim 10 wherein the relative density of $TiB_2$ and graphite support is lower than the relative density of the aluminum produced.

12. An electrically conductive cathode element for the production of aluminum by the Hall-Heroult process comprising:

an electrically conductive $TiB_2$ material as the active cathodic material which rests in apertures of a graphite suppport, wherein the relative density of the whole formed by the $TiB_2$ material and the graphite support is less than 2.3; and further wherein said active cathodic material comprises $TiB_2$ particles having a flat or slightly curved head portion and a tail or shank portion positioned in said aperture of said graphite support.

13. An electrically conductive cathode element of claim 12 wherein said active cathodic material are slotted circular or square tubes threaded onto a rail support.

14. An electrolytic cell for the production of aluminum by the Hall-Heroult process, the improvement comprising:

an electrically conductive $TiB_2$ material as the active cathodic material which rests in apertures of a graphite support wherein the relative density of the refractory material and graphite support is less than 2.3; and further wherein said active cathodic material comprises $TiB_2$ particles having a flat or slightly curved head portion and a tail or shank portion positioned in said apertures of graphite support;

a conductor plate;

an anchoring stud member which anchors said conductor plate to the cathodic substrate;

an abuttment means for limiting the vertical movement of said cathodic material which comprises the top portion of said anchoring stud member and the bottom portion of said conductor plate.

15. The electrolytic cell of claim 14 wherein said active cathodic material are slotted circular or square tubes threaded onto a rail support.

16. The electrolytic cell of claim 14 further comprising a mechanical guide means for limiting the lateral motion of said active cathode material, wherein said guide means are rollers consisting of $TiB_2$, silicon nitride or silicon and aluminum oxynitride.

17. An electrolytic cell for the production of aluminum by the Hall-Heroult process, the improvement comprising:

a plurality of electrically conductive $TiB_2$ elements as the active cathodic material wherein each element is associated with a graphite float and further wherein the combination of $TiB_2$ particles and graphite is fitted into a graphite ring; wherein the relative density of the $TiB_2$ element and graphite support is less than 2.3;

an abuttment means for limiting the vertical movement of said active cathodic material comprising a support of inert material which rests against the cathodic substrate by means of supports or feet.

18. The electrolytic cell of claim 17 wherein the $TiB_2$ element is a plate secured to said graphite float by means of a screw.

19. The electrolytic cell of claim 17 wherein the graphite float is a well or shaft closed at it's lower portion and filled with liquid aluminum.

20. The electrolytic cell of claim 17 wherein the $TiB_2$ elements rest on a graphite float by means of ribs or vanes.

* * * * *